US007549832B2

(12) United States Patent
Mailleux

(10) Patent No.: US 7,549,832 B2
(45) Date of Patent: Jun. 23, 2009

(54) DEVICE FOR COUPLING A LOADER TO A TRACTOR

(75) Inventor: Loic Mailleux, Rennes (FR)

(73) Assignee: Mailleux, Acigne (FR)

( * ) Notice: Subject to any disclaimer, the term of this patent is extended or adjusted under 35 U.S.C. 154(b) by 124 days.

(21) Appl. No.: 11/629,225

(22) PCT Filed: Jun. 6, 2005

(86) PCT No.: PCT/FR2005/001374

§ 371 (c)(1),
(2), (4) Date: Dec. 11, 2006

(87) PCT Pub. No.: WO2006/003286

PCT Pub. Date: Jan. 12, 2006

(65) Prior Publication Data

US 2007/0292254 A1 Dec. 20, 2007

(30) Foreign Application Priority Data

Jun. 10, 2004 (FR) ..... 04 06285

(51) Int. Cl.
*E02F 9/00* (2006.01)

(52) U.S. Cl. ..... 414/686; 172/274

(58) Field of Classification Search ..... 414/686, 414/723; 37/468; 172/272–275
See application file for complete search history.

(56) References Cited

U.S. PATENT DOCUMENTS 4,243,356 A 1/1981 Takojoma
4,798,511 A * 1/1989 Kaczmarczyk et al. ..... 414/686
5,387,075 A * 2/1995 Aoki ..... 414/686
6,386,821 B1 * 5/2002 Schneider ..... 414/686
6,422,805 B1 7/2002 Miller
2006/0245899 A1 * 11/2006 Lyons et al. ..... 414/686

FOREIGN PATENT DOCUMENTS

| | | |
|---|---|---|
| DE | 3 630 976 | 3/1987 |
| EP | 1 365 074 | 11/2003 |
| FR | 2 571 452 | 4/1986 |
| FR | 2 747 137 | 10/1997 |
| FR | 2 830 166 | 4/2003 |
| FR | 2 830 551 | 4/2003 |
| GB | 2 131 391 A | 6/1984 |

* cited by examiner

*Primary Examiner*—Donald Underwood
(74) *Attorney, Agent, or Firm*—Pauley Petersen & Erickson

(57) ABSTRACT

A device for couplng a loader to a tractor, wherein the hitching frame (1) of the loader is provided with two coupling projections (11, 12) or sockets (21, 22) and a latch (14) biased by a spring (15), the coupling head (2) of the tractor is provided with two complementary coupling members and locking means (25, 25'), and said latch (14) engages said locking means (25, 25') to lock the load onto the tractor. Said device is characterised in that the coupling head (2) includes pre-locking means (24, 24') engageable by said latch (14) in a pre-locking position in which said projections (11, 12) and sockets (21, 22) are not fully coupled, and the spring (15) continually urges said latch (14) into the locking or pre-locking position.

20 Claims, 5 Drawing Sheets

FIG. 4
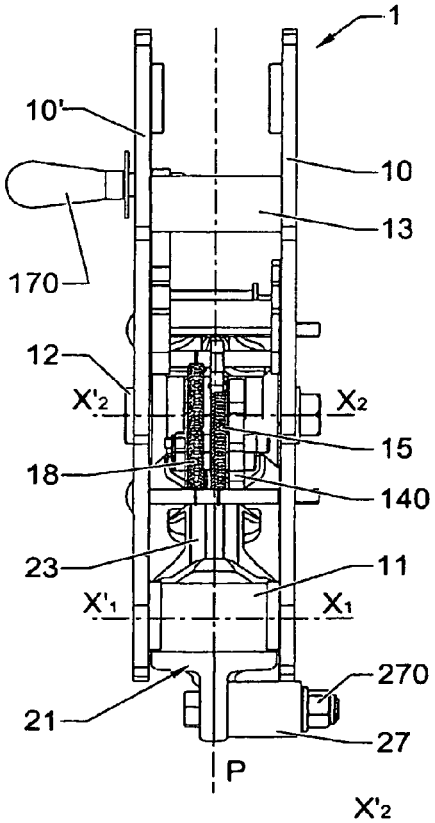
FIG. 5
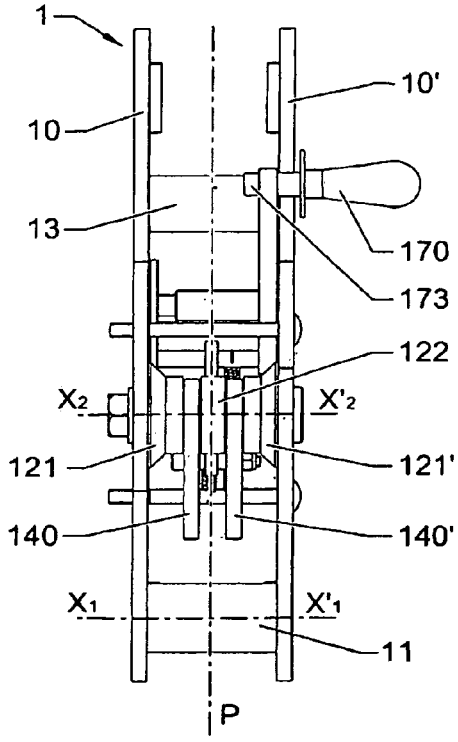
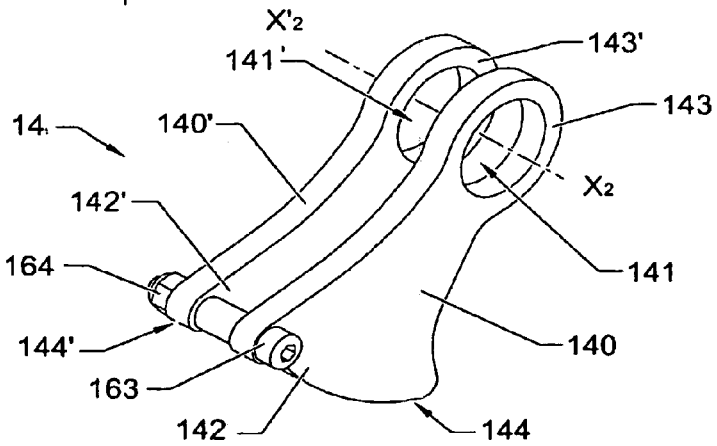
FIG. 6

DEVICE FOR COUPLING A LOADER TO A TRACTOR

The present invention relates to a device for coupling a loader to a tractor.

A loader, in particular a front loader, is a piece of equipment designed to be mounted at the front of an agricultural tractor to perform all tasks of handling a variety of materials, such as, for example: straw, hay, manure, or earth.

With reference to accompanying FIG. 1, there can be seen a loader C and a tractor T.

The tractor T is provided with an adapter frame BA that constitutes the interface between the loader and the tractor, and that is of a shape that is adapted to each model of tractor. The adapter frame BA supports two coupling heads 2, one on either side of the tractor.

In conventional manner, the front loader C comprises a hinged boom B provided at its front end with a tool-carrier frame CPO having a tool O mounted thereon, in this case a bucket. The boom B comprises two parallel arms. The rear end of each arm is provided with a coupling frame 1.

The loader C also includes a pair of lift actuators V (only one of which is visible on the corresponding side view of FIG. 1) enabling the two arms of the boom B to pivot about hinge axes carried by the coupling frames 1.

Each coupling frame 1 constitutes the stationary portion of the loader, designed to be secured to the facing coupling head 2.

In coupling devices known in the prior art, each coupling frame 1 of the loader C is secured to the corresponding coupling head 2 of the tractor T by means of at least one pair of complementary male and female coupling members.

In use, the operator causes the tractor T to advance towards the loader C which is resting on the ground and is propped up by struts BE. The tractor continues to move forwards until the male or female members carried by the coupling frame 1 couple respectively with the female or male members carried by the coupling head 2. Locking means are then engaged, generally automatically for locking the coupling.

The operator then gets down from the tractor to establish the hydraulic circuit connections between the actuators V of the loader C and the hydraulic power source carried by the tractor T, after which the operator removes the struts BE.

The user can then begin to raise and use the loader.

Thus, document FR 2 571 452 discloses a device for automatically coupling a front loader to a tractor.

In that device, each coupling head of the tractor has two coupling cavities and an abutment, and each jib of the loader has two bars to be received in said cavities, and a catch biased by a spring.

While the loader and the tractor are being assembled together, the bars engage in the cavities and they are locked in position by the catch co-operating with said abutment.

A similar fastener device is described in document DE 36 30976.

In theory, it would be desirable to couple and lock the loader to the tractor automatically and in a single operation.

In practice, this operation is difficult to perform when the loader C is placed on soft ground or on an irregular surface since it can then be wobbly or at the wrong height relative to the tractor T. As a result, the coupling frames of the loader are not necessarily accurately in register with the coupling means of each of the coupling heads.

Consequently, in some cases, the loader C is not correctly locked to the tractor T and when the user begins to raise the loader it becomes detached and falls off. Such a drop can be extremely damaging to the loader and can also be dangerous for any operator who might be present nearby.

An object of the present invention is thus to provide a device for coupling a loader C to a tractor T that can be prelocked in such a manner as to enable the operator to establish the hydraulic connections and remove the struts propping up the loader without any risk of it falling.

Another object of the invention is that once the coupling device has been prelocked, the operator can make use of the hydraulic controls for centering the loader relative to the tractor and for bringing it into its final position in which it can then be locked.

To this end, the invention relates to a coupling device for coupling a loader to a tractor, the coupling frame of the loader being provided with one of two male or female coupling members of each of two pairs of so-called "front" and "rear" coupling members, and with a catch biased by a spring, the coupling head of an adapter frame carried by said tractor being provided with two coupling members complementary to those carried by said coupling frame and with locking means, said catch co-operating with said locking means to occupy a so-called "locking" position in which said male members are fully coupled with said female members.

In accordance with the invention, said coupling head includes prelocking means with which said catch can co-operate to occupy a so-called "prelocking" position in which the male and female members of each pair are engaged in an incomplete manner, such that the loader is secured to the tractor while leaving clearance between the male and female members allowing the position of the loader to be adjusted relative to the tractor, the spring tending continuously to hold said catch in the locking or prelocking position.

By means of these characteristics of the invention, it is possible to secure the loader to the tractor even if the loader is not accurately positioned and centered relative to the tractor. Using the hydraulic actuators, the operator can lift the loader C a little in order to position it better and adjust its final positioning before locking the coupling means.

According to other characteristics of the invention that are advantageous but non-limiting, and that can be taken singly or in combination:

- the male coupling members are constituted by respective bars and the female coupling members by respective U-shaped couplers, each bar being disposed in the opening of the U-shaped coupler when the catch is in the prelocking position, and being fully engaged in the bottom of the U-shaped coupler when the catch is in the locking position;
- the male coupling members form part of the coupling frame and the female coupling members form part of the coupling head;
- the catch is mounted to pivot about a pin carried by the coupling frame;
- the pivot pin of the catch is the bar of the rear pair of coupling members;
- said coupling head includes a rolling ramp situated in front of the U-shaped coupler of the rear pair of coupling members, a prelocking notch and a locking abutment suitable for co-operating with said catch being provided on either side of said rolling ramp, and the catch comprises two half-catches suitable for engaging on either side of said ramp;
- the bar of the rear pair of coupling members presents in its middle portion a roller mounted to rotate freely and suitable for rolling on the rolling ramp of the coupling head;

said catch can be moved from the locking position or the prelocking position into a "unlocking" position in which it does not co-operate with said locking or prelocking means, such that the loader can be separated from the tractor, the catch being moved into this unlocking position with the help of a control lever acting against the return force of the spring of said catch;

said coupling frame includes a blocking cavity which enables said control lever to be blocked in the position in which said catch is in the unlocking position;

the second end of the coupling head includes an unblocking recess which serves during decoupling of the loader from the tractor to cause the control lever to leave said blocking cavity in order to release said catch; and said coupling head includes a lateral guide roller for guiding the bottom edge of one of the side plates of the coupling frame of the loader during the operations of coupling and decoupling the loader and the tractor.

Other characteristics and advantages of the invention appear from the following description given with reference to the accompanying drawings which show possible embodiments of the invention by way of non-limiting indication.

In the drawings:

FIG. 4 is a view of the front of the coupling device, the frame and the coupling head being coupled together;

FIG. 5 is a view of the rear of the coupling frame on its own;

FIG. 6 is a perspective view of the catch;

FIGS. 7A to 7F are diagrams showing the successive steps of engagement, of prelocking, and of locking the coupling frame to the coupling head, one of the side plates of the coupling frame being removed for simplification purposes; and FIGS. 8A to 8F are diagrams showing the successive steps of unlocking and disengaging the frame from the coupling head, one of the side plates of the frame being partially truncated on a circular arc to make the parts more visible.

The coupling frame 1 shown in FIGS. 2 to 5 is the frame for securing to the right-hand side of the tractor. It has two parallel side plates that are spaced apart from each other, with the inside side plate, i.e. the side plate facing the tractor being given numerical reference 10 and the other side plate reference 10'.

Figure 1:
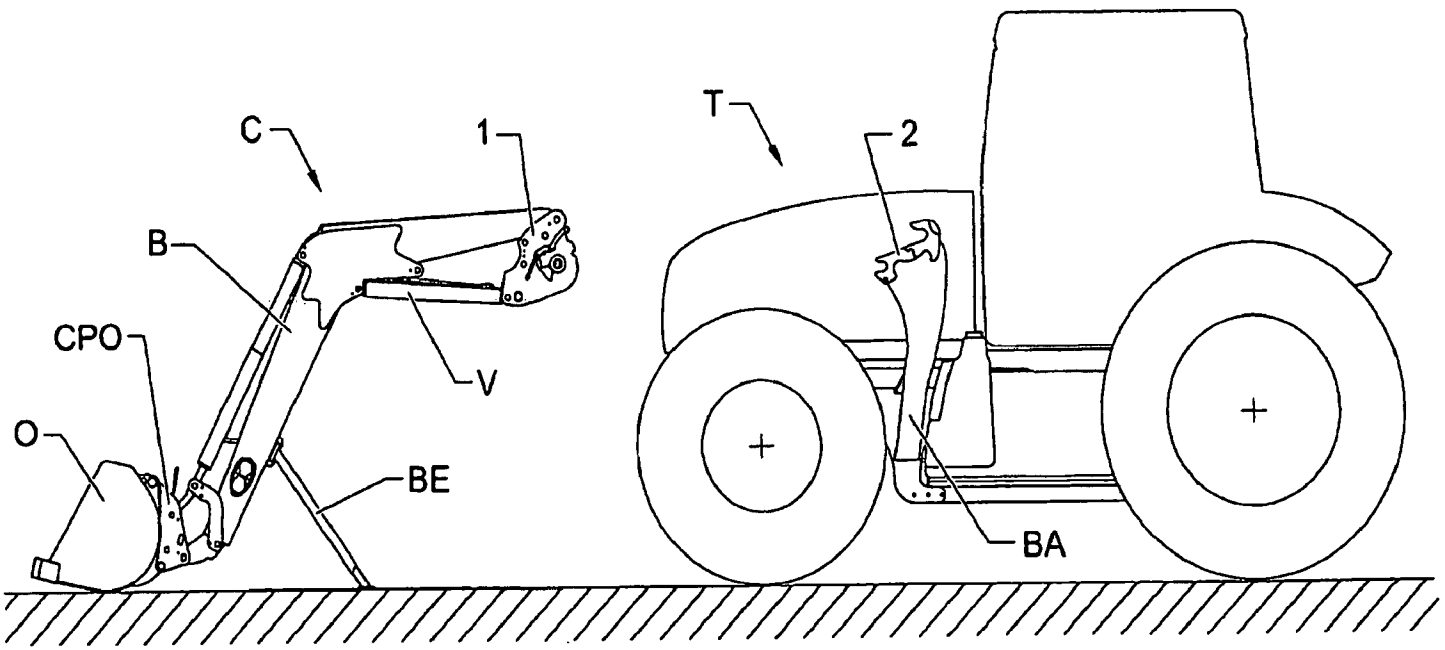
FIG. 1 is a general diagram showing a loader ready for connection to an agricultural tractor, using the fastener device in accordance with the invention.
Figure 2:
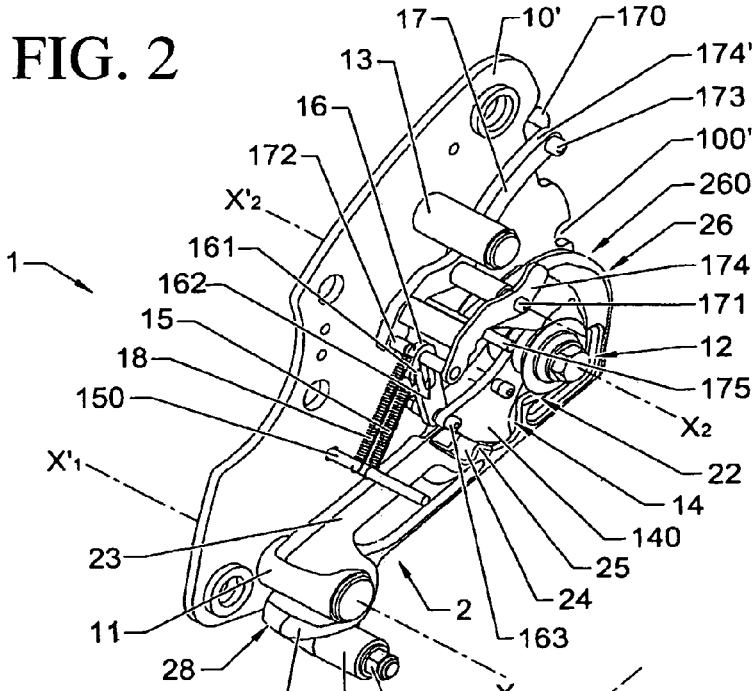
FIG. 2 is a perspective view of the device in accordance with the invention with one of the side plates of the coupling frame removed.

With reference to FIGS. 2 and 4, it can be seen that during coupling, the coupling head 2 is inserted between the two side plates 10 and 10'.

The coupling head 2 is described below in greater detail.

It is constituted by a part of elongate shape having thickness that enables it to penetrate between the two side plates 10 and 10'. It is almost symmetrical about a vertical midplane referenced P.

The coupling head 2 presents two ends referred to as a "front" end and as a "rear" end relative to the travel direction of the tractor, and referenced respectively 28 and 26.

At each of its two ends 28 and 26, it has two U-shaped couplers referenced respectively 21 and 22, referred to as the "front coupler" and as the "rear coupler".

Each of these U-shaped couplers constitutes the female member of a pair of coupling members. Their concave sides are directed towards the front of the tractor. The central axes of their concave portions are perpendicular to the plane P.

Figure 3:
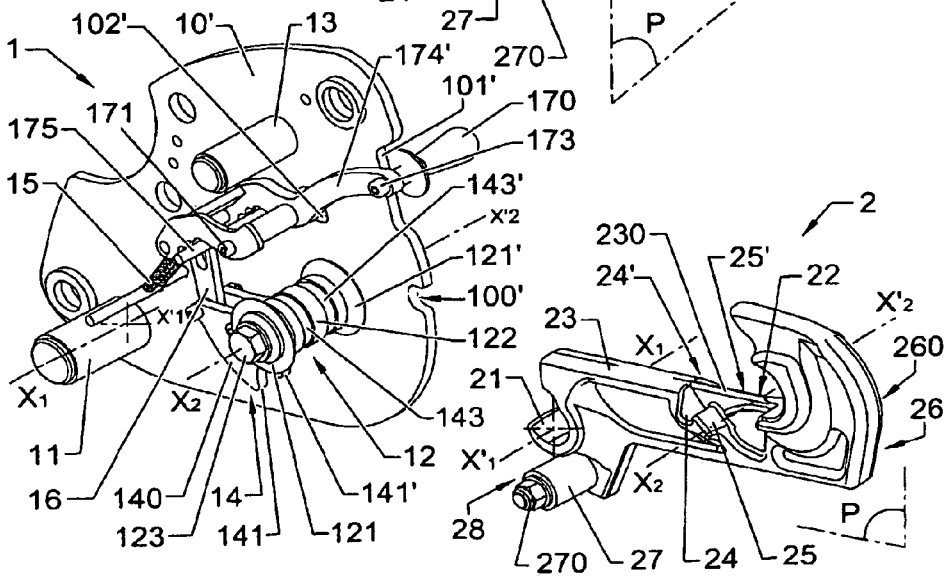
FIG. 3 is a perspective view similar to FIG. 2 but seen from a different angle, the frame and the coupling head being spaced apart from each other.

As can be seen better in FIG. 3, the top edge 23 of the coupling head 2 extends from a zone situated above the front coupler 21 to the inlet to the rear coupler 22. This edge 23 constitutes a rolling ramp sloping slightly upwards from the front towards the rear of the head 2.

Two notches 24 and 24', referred to as "prelocking notches" are formed on either side of the rolling ramp 23, substantially halfway along the ramp.

These notches are symmetrical about the vertical midplane P. In side view they are V-shaped and upwardly-open.

Two abutments 25, 25', referred to as "locking" abutments are also provided on either side of the rolling ramp 23. They are symmetrical about the plane P.

These abutments 25 and 25' are disposed in the immediate proximity of the notches 24 and 24' respectively, and between the notches and the rear coupler 22.

In the vicinity of the notches 24, 24' and the abutments 25, 25', the rolling ramp 23 is of smaller thickness than in its front portion. The narrower portion of the rolling ramp 23 situated between the notches and the abutments is given reference 230.

A recess 260 is formed in the outwardly-facing face of the rounded rear end 26 of the coupling head 2. Its concave side faces towards the rear of the tractor. This recess is visible in FIGS. 7 and 8.

Finally, the head 2 includes, under the front coupler 21, a lateral guide roller 27 mounted to turn freely about an axis 270 perpendicular to the plane P.

This guide roller 27 is offset a little towards the inside of the tractor relative to the midplane P.

The coupling frame 1 is described below in greater detail.

It has two parallel bars secured between the two side plates 10 and 10'. In the position for coupling the frame 1 with the coupling head 2, the side plates 10 and 10' extend in planes that are parallel to the midplane P.

The bar for coupling with the front coupler 21 is referred to as the "front" bar and is given numerical reference 11, while the bar for coupling with the rear coupler 22 is referred to as the "rear" bar and is given numerical reference 12.

These bars 11 and 12 extend on respective axes X1-X'1 and X2-X'2 that are perpendicular to the planes of the side plates 10 and 10'. Each bar constitutes the male member of a pair of coupling members.

A spacer 13 extends between the two side plates 10 and 10', and is disposed substantially above the bar 12.

The coupling frame 1 also includes a catch 14 mounted to pivot at one of its ends about an axis perpendicular to the planes of the two side plates 10 and 10'.

Advantageously, the axis about which the catch 14 pivots is the rear bar 12.

As can be seen better in FIG. 6, the catch 14 is constituted by two parallel half-catches 140, 140', each of generally triangular shape with a downwardly-directed tip.

Each half-catch 140 has a front end 142, a front face 144, and a rear end 143 pierced by an orifice 141 for passing the axis X2-X'2 of the bar 12. The half-catch 140' is identical in structure and the same elements are given the same numerical references together with a prime symbol.

The two half-catches 140 and 140' are also united at their front ends 142, 142' by fastener means such as a bolt 163 and a nut 164.

The structure of the bar 12 is described in detail below with reference to FIG. 3. It is generally in the form of a spool.

It has a central shaft (not visible in the figures) represented solely by the axis line X2-X'2, two conical side portions 121 and 121' whose tips point towards each other, and a central roller 122 mounted to turn freely about said axis X2-X'2.

Each conical portion 121, 121' is pierced by a central orifice for passing the axis X2-X'2, and is welded to a respective one of the side plates 10 and 10'.

The cylindrical shaft X2-X'2 abuts against one of the side plates and is secured to the other, e.g. by means of a bolt 123, so as to be separable.

Finally, the rear ends 143 and 143' of the two half-catches 140 and 140' are mounted to pivot about said axis and are inserted between the roller 122 and the two conical portions 121 and 121'.

The catch 14 is also permanently biased by means of a helical spring 15.

For this purpose, a link 16 is interposed between the front ends 142, 142' of the two half-catches 140 and 140'. It lies in the vertical midplane P.

Its bottom end is pierced by an orifice for passing the bolt 163.

The top end is pierced by an oblong orifice 162.

Finally, the spring 15 is secured at its bottom end to a fastening pin 150 which extends between the two side plates 10 and 10', perpendicularly thereto, and at its top end 152 to an orifice 61 formed in the link 16.

The spring 15 exerts traction on the top end of the link 16, thereby tending to urge the catch 14 continuously downwards.

A lever 17 extends between the two side plates 10 and 10' parallel to the plane P. It comprises two parallel arms, namely a longer outer arm 174' and a shorter inner arm 174.

The lever 17 is hinged about a pivot pin 171 perpendicular to the plane P and is mounted at its two ends between the two side plates 10 and 10'.

More precisely, an orifice for receiving one of the ends of said pivot pin 171 is formed in each of the side plates 10, 10'. This orifice is substantially triangular in shape with rounded corners, and its dimensions are slightly greater than those of the ends of the pin 171.

Only the reception orifice 102' formed in the side plate 10' can be seen in FIGS. 3, 7, and 8.

Figure 8C:
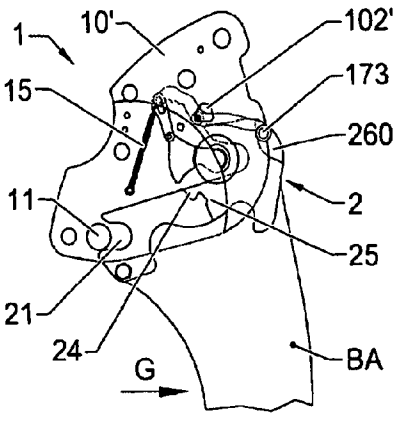
Figure 8B:
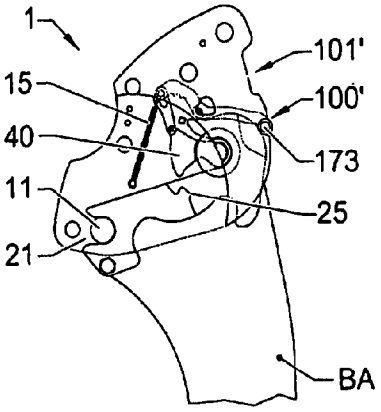
Figure 8A:
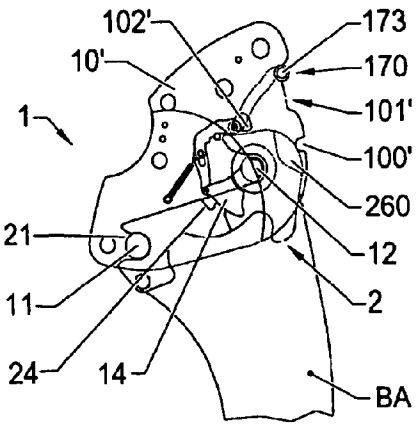
Figure 8F:
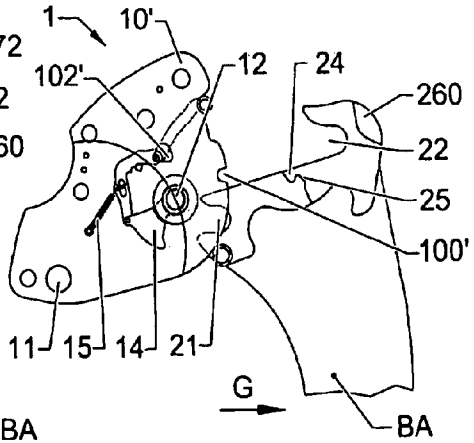
Figure 8E:
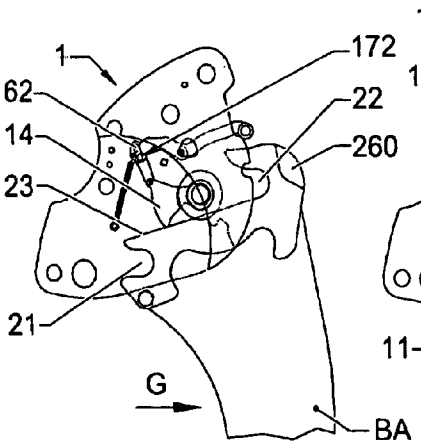
Figure 8D:
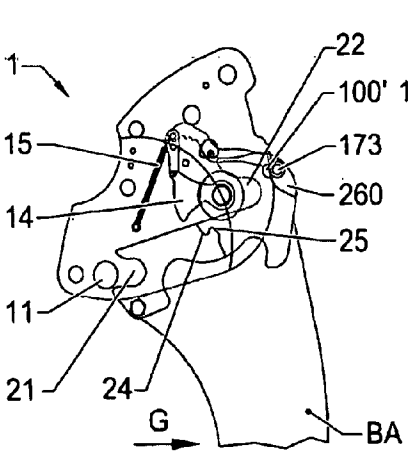

The pivot pin 171 is mounted between the two side plates 10 and 10' in such a manner that its ends rest on the edge faces of said reception orifices, allowing it to move with a small amount of clearance inside these orifices, as can be seen in FIGS. 8C and 8D, for example.

A rod 172 is secured between the front ends of the two arms 174 and 174', perpendicularly to the plane P. It passes through the oblong orifice 162 in the link 16, within which it is free to move. This oblong orifice 162 leaves a small amount of slack between the lever 17 and the link 16.

A second helical spring 18 is disposed parallel to the first spring 15. Its bottom end is secured to the pin 150 and its top end to the rod 172. This spring 18 tends to bring the front end of the lever 17 permanently downwards, into the position shown in FIG. 2.

Furthermore, a rod 175 forming an abutment for the lever 17 is secured between the two side plates 10 and 10', perpendicularly thereto, under the portion of the lever 17 that extends between its front end and the pin 171.

In addition, the outer arm 174' of the lever 17 is provided at its rear end with a handle 170 that projects towards the outside of the tractor, perpendicularly to the plane P, out from the outer side plate 10'.

When an operator lowers the handle 170, the lever 17 pivots about its pin 171, and its front end carrying the rod 172 lifts the link 16 against the return force of the springs 15 and 18, thereby lifting the catch 14.

In addition, the outer arm 174' of the lever 17 has a stud 173 at its rear end, on its face opposite from the face to which the handle 170 is secured. This stud is suitable for co-operating with the recess 260 in the coupling head 2, as described below.

Finally, the outer side plate 10' presents along its rear edge, in its top portion, a setback 101' which constitutes an abutment to upward displacement of the lever 17, and in its middle portion it includes a cavity 100'.

One possible embodiment of the device is described above.

In another variant that is not shown, it is possible, without going beyond the ambit of the invention, to invert the male and female members so that at least one of the male pins 11, 12 is secured to the head 2 and at least one of the U-shaped couplers 21, 22 is secured to the frame 1.

Similarly, the catch 14 could be slidably rather than pivotally mounted.

The operation of the device is explained below in greater detail.

The stage of coupling the coupling frame 1 on the coupling head 2 is described with reference to FIGS. 7A to 7F.

Figures 7A, 7B, 7C, 7D, 7E, 7F:
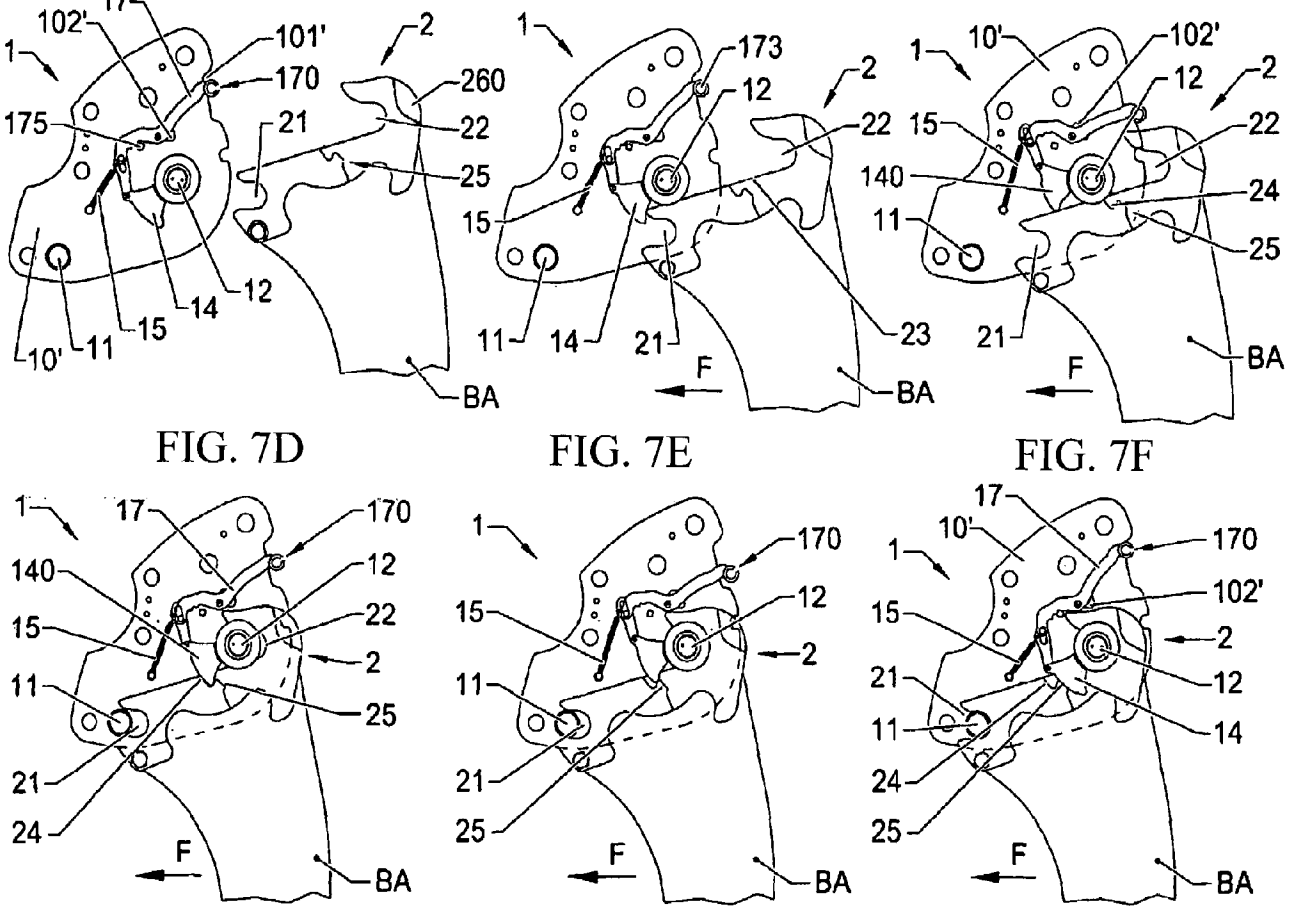

In FIG. 7A, the loader and the tractor are spaced apart from each other. The catch 14 is in the rest position, i.e. it is held in a low position under drive from the return spring 15. The handle 170 comes into abutment against the top of the setback 101', and the front portion of the lever 17 is against the rod 175.

The operator then moves the tractor in the direction of arrow F. When the front end of the U-shaped coupler 21 comes into contact with the catch 14, it tends to lift it upwards a little against the force of the spring 15.

The idle roller 122 of the bar 12 begins to roll freely along the rolling ramp 23, with the conical portions 121 and 121' of the spool-shaped bar facilitating alignment of the coupling frame 1 in the midplane P of the coupling head 2.

With reference to FIG. 7C, it can be seen that when the tractor continues to advance to the left, the ends of the two half-catches 140 and 140' also move along the rolling ramp 23 (the half-catch 140' does not appear in the side views of FIG. 7).

When the coupling head 2 reaches the position shown in FIG. 7D, the two half-catches 140 and 140' come into register with the notches 24 and 24' formed on either side of the rolling ramp 23. Under drive from the spring 15, the catch 14 is pressed downwards, each half-catch becoming engaged in a respective notch 24, 24'. The catch 14 is then in a so-called "prelocking" position.

In this position, the bars 11 and 12 are inserted into the entrances of the U-shaped couplers 21 and 22 respectively. The coupling frame 1 of the loader is thus secured to the coupling head 2 of the adapter frame of the tractor.

In this prelocking position, the operator can get down from the tractor, establish the connections in the hydraulic system, and withdraw the struts, without running the risk of the loader becoming detached from the tractor.

Then, by operating the hydraulic feed means, the operator can simultaneously lift the loader a little and continue to cause the tractor to advance, to the left in the figures. This enables the bars 11 and 12 to be centered correctly so that their respective axes X1-X'1 and X2-X'2 are perpendicular to the midplane P of the coupling head 2.

This action brings the coupling frame and the head into the position shown in FIG. 7E. The catch 14 is raised a little to escape from the notches 24 and 24' and reach the final locking position as shown in FIG. 7F.

In this position, the catch 14 has returned to its original position pointing downwards as far as possible. The front faces 144, 144' of the catch 14 then come into contact with the abutments 25 and 25', respectively.

In this position, the lever 17 and its handle 170 are raised as far as possible.

The stage of uncoupling the loader is described in detail below with reference to FIGS. 8A to 8F.

FIG. 8A corresponds to FIG. 7F.

As shown in FIG. 8B, the operator lowers the lever 17 using its handle 170 bringing it downwards until the handle 170 is held in the cavity 100'.

In this so-called "unlocking" position, the catch 14 is raised by the lever 17 against the return force of the spring 15, the two half-catches 140 and 140' then no longer being in contact with the abutments 25 and 25'.

As shown in FIG. 8C, the operator can then begin to reverse the tractor and the coupling head 2 towards the right (arrow G).

During this operation, the stud 173 comes into contact with the recess 260 in the coupling head 2.

As the tractor continues to reverse, as shown in FIG. 8D, the rim of the recess 260 acts on the stud 173 and entrains it rearwards a little, which is possible since the pivot pin 171 of the lever 17 is mounted with a certain amount of clearance in the recesses 102'. At the other end of the lever, this has the effect of releasing the handle 170 from the cavity 100'.

With the lever 17 released, the return springs 15 and 18 tend to urge the catch 14 downwards. Nevertheless, the catch 14 is then in register with the rolling ramp 23 and cannot move all the way down. The idle roller 122 continues to roll along the ramp 23. Under drive from the spring 18 the lever tends to return towards its original position and the rod 172 takes up a position in the bottom of the oblong orifice 162.

Finally, once the coupling head 2 has reversed completely, the catch 14 is released and the return spring 15 tends to bring it into its original position as shown in FIG. 8F so that the coupling frame 1 is ready for coupling again.

The invention claimed is:

1. A coupling device comprising a coupling frame and an adapter frame having a coupling head, for coupling a loader (C) to a tractor (T), the coupling frame (1) carriable by the loader (C) being provided with one of two male or female coupling members (11, 12; 21, 22) of each of two pairs of "front" and "rear" coupling members (11, 21; 12, 22), and with a catch (14) biased by a spring (15), the coupling head (2) of the adapter frame (BA) carriable by said tractor (T) being provided with two coupling members (12, 11; 22, 21) complementary to those carried by said coupling frame (1) and with locking means (25, 25'), said catch (14) co-operating with said locking means (25, 25') to occupy a "locking" position in which said male members (11, 12) are fully coupled with said female members (21, 22), the device being characterized in that said coupling head (2) includes prelocking means (24, 24') with which said catch (14) can co-operate to occupy a "prelocking" position in which the male and female members (11, 12; 21, 22) of each pair are engaged in an incomplete manner, such that the loader (C) is secured to the tractor (T) while leaving clearance between the male and female members (11, 12; 21, 22) allowing the position of the loader (C) to be adjusted relative to the tractor (T), the spring (15) tending continuously to hold said catch (14) in the locking or prelocking position.

2. A coupling device according to claim 1, characterized in that the male coupling members (11, 12) are constituted by respective bars and the female coupling members (21, 22) by respective U-shaped couplers, each bar (11, 12) being disposed in the opening of one of the U-shaped couplers (21, 22) when the catch (14) is in the prelocking position, and being fully engaged in the bottom of the U-shaped coupler when the catch (14) is in the locking position.

3. A coupling device according to claim 1, characterized in that the male coupling members (11, 12) form part of the coupling frame (1) and the female coupling members (21, 22) form part of the coupling head (2).

4. A coupling device according to claim 1, characterized in that the catch (14) is mounted to pivot about a pivot pin carried by the coupling frame (1).

5. A coupling device according to claim 3, characterized in that the catch (14) is mounted to pivot about a pivot pin carried by the coupling frame (1) and in that said pivot pin of the catch (14) is a bar (12) of the rear pair of coupling members (12, 22).

6. A coupling device according to claim 2, characterized in that said coupling head (2) includes a rolling ramp (23) situated in front of the U-shaped coupler (22) of the rear pair of coupling members, the prelocking means (24, 2') and the locking means (25, 25') suitable for co-operating with said catch (14) being provided on either side of said rolling ramp (23), and in that the catch (14) comprises two half-catches (140, 140') suitable for engaging on either side of said ramp (23).

7. A coupling device according to claim 6, characterized in that the bar (12) of the rear pair of coupling members (12, 22) presents in its middle portion a roller (122) mounted to rotate freely and suitable for rolling on the rolling ramp (23) of the coupling head (2).

8. A coupling device according to claim 1, characterized in that said catch (14) can be moved from the locking position or the prelocking position into a "unlocking" position in which it does not co-operate with said locking or prelocking means (25, 25'; 24, 24'), such that the loader (C) can be separated from the tractor (T), the catch being moved into this unlocking position with the help of a control lever (17) acting against the return force of the spring (15) of said catch.

9. A coupling device according to claim 8, characterized in that said coupling frame (1) includes a blocking cavity (100') which enables said control lever (17) to be blocked in the position in which said catch (14) is in the unlocking position.

10. A coupling device according to claim 9, characterized in that an end (26) of the coupling head (2) includes an unblocking recess (260) which serves during decoupling of the loader (C) from the tractor (T) to cause the control lever (17) to leave said blocking cavity (100') in order to release said catch (14).

11. A coupling device according to claim 1, characterized in that said coupling head (2) includes a lateral guide roller (27) for guiding the bottom edge of one side plate (10) of the coupling frame (1) of the loader during the operations of coupling and decoupling the loader (C) and the tractor (T).

12. A coupling device according to claim 4, characterized in that the rear male coupling member (12) is a bar and in that the pivot pin of the catch (14) is said bar (12).

13. A coupling device for coupling a loader to a tractor, the coupling device comprising:

a coupling frame carriable by the loader and having a male or female front coupling member and a male or female rear coupling member;

an adapter frame carriable by the tractor and having a coupling head, the coupling head having locking means, prelocking means, and two coupling members complementary to those carried by said coupling frame, such that each pair of two pairs of coupling members includes one female coupling member and one male coupling member;

a catch mounted with respect to the coupling frame and biased by a spring, said catch co-operating with said locking means to occupy a locking position in which said male coupling members are fully coupled with said female coupling members, said catch co-operating with said prelocking means to occupy a prelocking position in which the male and female coupling members of each pair are engaged in an incomplete manner, such that the loader is secured to the tractor while leaving clearance between the male and female coupling members allowing the position of the loader to be adjusted relative to the tractor, the spring tending continuously to hold said catch in the locking or prelocking position.

14. The coupling device according to claim 13, wherein the male coupling members are bars and the female coupling members are U-shaped couplers, each bar being disposed in the opening of one of the U-shaped couplers when the catch is in the prelocking position, and being fully engaged in the bottom of the U-shaped coupler when the catch is in the locking position.

15. The coupling device according to claim 13, wherein the coupling frame comprises male coupling members and the coupling head comprises female coupling members.

16. The coupling device according to claim 13, wherein the catch pivots about a pivot pin carried by the coupling frame.

17. The coupling device according to claim 16, wherein the rear coupling member is a bar and the pivot pin is the bar.

18. The coupling device according to claim 14, wherein the coupling head comprises a rolling ramp positioned in front of the U-shaped coupler of the rear pair of coupling members, the prelocking means and the locking means for co-operating with the catch are provided on either side of the rolling ramp, the catch comprises two half-catches engageable on either side of the rolling ramp.

19. The coupling device according to claim 13, wherein the catch is movable from the locking position or the prelocking position into an unlocking position wherein the catch does not co-operate with the locking means or the prolocking means, the catch is movable into the unlocking position by a control lever acting against a return force of the spring of the catch.

20. The coupling device according to claim 19, wherein the coupling frame comprises a blocking cavity, wherein the control lever is blocked in the blocking cavity when the catch is in the unlocking position, the catch is released when the control lever leaves the blocking cavity.

* * * * *